US005656367A

United States Patent [19]

Iovine et al.

[11] Patent Number: 5,656,367

[45] Date of Patent: Aug. 12, 1997

[54] POLY(HYDROXYBUTYRATE/ HYDROXYVALERATE) COPOLYMERS FOR FIBER BONDING

[75] Inventors: Carmine P. Iovine, Bridgewater; John H. Walton, Flemington, both of N.J.

[73] Assignee: National Starch and Chemical Investment Holding Corporation, Wilmington, Del.

[21] Appl. No.: 236,774

[22] Filed: Apr. 29, 1994

[51] Int. Cl.[6] ..... C08L 93/04; B32B 27/00; D04H 1/00; D04H 3/00

[52] U.S. Cl. ..... 442/152; 524/270; 524/271; 524/272; 442/153

[58] Field of Search ..... 524/270, 271, 524/272; 428/224, 288, 290, 289

[56] References Cited

U.S. PATENT DOCUMENTS

| | | | |
|---|---|---|---|
| 5,097,004 | 3/1992 | Gallagher et al. | 528/272 |
| 5,169,889 | 12/1992 | Kauffman et al. | 524/270 |

*Primary Examiner*—Patrick Ryan
*Assistant Examiner*—Rich Weisberger
*Attorney, Agent, or Firm*—Jane E. Gennaro

[57] ABSTRACT

A biodegradable binder for nonwoven stock is prepared as an emulsion of 5–200% solids of poly(hydroxybutyrate/ hydroxyvalerate) copolymer in water in which the copolymer comprises 70–100 mole percent of 3-hydroxybutyrate and 0–30 percent of 3-hydroxyvalerate.

4 Claims, No Drawings

POLY(HYDROXYBUTYRATE/ HYDROXYVALERATE) COPOLYMERS FOR FIBER BONDING

This invention relates to a biodegradable binder for biodegradable nonwoven stock. More particularly, this invention is a biodegradable nonwoven disposable stock and a biodegradable emulsion binder for that stock that can be completely converted to carbon dioxide and energy by micro-organisms in waste disposal plants, composting facilities, and landfills. The biodegradable binder is prepared as an emulsion polymer from 70–100 mole % of 3-hydroxybutyrate and 0–30 mole % of 3-hydroxyvalerate.

DETAILED DESCRIPTION OF THE INVENTION

The copolymer of poly(3-hydroxybutyrate-3-hydroxyvalerate) is a natural polymer synthesized by the bacteria *Alcaligenes entrophus* and is commercially available under the tradename Biopol from ICI Americas Inc., Wilmington, Del. (3-Hydroxyvalerate is the trivial name of 3-hydroxypentanoate.) The copolymer is comprised of repeating units of the following structure in which the hydroxybutyrate is present in an amount from 70–100 mole percent and the hydroxyvalerate may be present in an amount up to 30 mole percent.

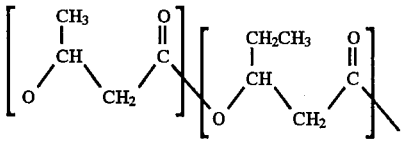

hydroxybutyrate hydroxyvalerate

Although it would be possible to synthesize the copolymer in any ratio of butyrate to valerate, it has been found that increasing amounts of hydroxyvalerate result in decreasing stiffness. Therefore, when this copolymer is used as a binder for nonwoven stock, the preferred amount of hydroxyvalerate incorporated into the copolymer will be less than 30 mole percent.

The copolymer is obtained in granules or powder form and formulated into a binder suitable for nonwoven stock by standard emulsification techniques. In general, the samples are dissolved in a suitable organic solvent and then emulsified in water with the addition of a standard emulsifying agent or a protective colloid. Although other organic solvents may be used, it has been found that a mixture of methylene chloride/1,2-dichloroethane, preferably in a ratio of 1:1, is suitable for dissolving the copolymers. This solution is microfluidized at high pressure to make a more homogenous mixture. The organic solvent is then removed to give a coarse emulsion. This emulsion readily adheres to biodegradable substrates, such as, cellulosic rayon, cellulosic pulp, viscose, wool, cotton, and cellulose acetate, with cellulosic rayon being the preferred substrate.

The emulsifying agents used in the emulsification can be one or more of any of the generally known and used anionic, cationic or nonionic emulsifiers. Examples of suitable anionic emulsifiers are alkyl sulfonates, alkylaryl sulfonates, alkyl sulfates, sulfates of hydroxyalkanols, alkyl and alkylaryl disulfonates, sulfonated fatty acids, sulfates and phosphates of polyethoxylated alkanols and alkylphenols, and esters of sulfosuccinic acid. Examples of suitable cationic emulsifiers are alkyl quaternary ammonium salts and alkyl quaternary phosphonium salts. Examples of suitable nonionic emulsifiers are the addition products of 5 to 50 moles of ethylene oxide adducted to straight-chain and branched-chain alkanols with 6 to 22 carbon atoms, or alkylphenols, or higher fatty acids, or higher fatty acid amides, or primary and secondary higher alkylamines, and block copolymers of propylene oxide with ethylene oxide. Combinations of these emulsifying agents may also be used, in which case it is advantageous to use a relatively hydrophobic emulsifying agent in combination with a relatively hydrophilic agent. The amount of emulsifying agent used is generally from about 1% to 10%, preferably from about 2% to 8%, by weight of the monomers used in the polymerization.

Various protective colloids may also be used in place of, or in addition to, the emulsifiers. Suitable colloids include polyvinyl alcohol, partially acetylated polyvinyl alcohol (e.g., up to 50% acetylated), casein, hydroxyethyl starch, carboxymethyl cellulose, gum arabic, and the like, as known in the art of synthetic emulsion polymer technology. In general, these colloids are used at levels of 0.5 to 10 percent by weight of the total emulsion. The preferred emulsifying agent is polyvinyl alcohol, present in an amount from about 2 to about 7 percent by weight of total emulsion weight.

The emulsifier or protective colloid can be added in its entirety to the water into which the polymer is added, either before emulsification, or a portion (e.g. 25% to 90%) can be added continuously or intermittently during emulsification. The particle size of the emulsion can be regulated by the quantity of nonionic or anionic emulsifying agent or protective colloid employed. To obtain smaller particle sizes, greater amounts of emulsifying agents are used. As a general rule, the greater the amount of the emulsifying agent employed, the smaller the average particle size.

The emulsified binder is then suitably used to impregnate nonwoven fabrics prepared from biodegradable fibers by a variety of methods known in the art. In general, the fibers are loosely assembled into a web by any one of the conventional techniques, such as, carding, garnetting, or air-laying, in which the fibers extend in a plurality of diverse directions in general alignment with the major plane of the fabric, overlapping, intersecting and supporting one another to form an open, porous structure. The biodegradable fibers may be natural or synthetic, such as, cellulosic rayon, cellulosic pulp, viscose, wool, cotton, and cellulose acetate.

The starting fibrous web preferably weighs from about 10 to about 150 grams per square meter, more preferably from about 20 to about 35 grams per square meter. After formation, the starting noonwoven fabric (fibrous web) is impregnated with the emulsion in an amount calculated on a dry basis of about 50–200 parts emulsion per 100 parts by weight of the unbound fabric.

After impregnation with binder, the web is dried, usually by passing it through an air oven or over sections of heated cans. Ordinarily, convection air drying is effected at 100° to about 125° C. for 3 minutes. After drying the fabric is cured, usually by passing it through a curing oven or over additional sections of hot cans at 150° to about 200° C. for 5 minutes. Curing the fabric made with poly(hydroxybutyrate/hydroxyvalerate) copolymer is necessary to provide a uniform binder film in order to reach strength performance targets. Generally, curing time is approximately 5 minutes at 180° C. in a forced air oven. However, other time-temperature relationships can be employed, for example, shorter times at higher temperatures or longer times at lower temperatures, as is recognized to one skilled in the art.

The following examples show that the bound nonwovens exhibit good dry and wet tensile strength at about 100% pick-up of emulsion binder and in soil degradation tests exhibit biodegradability.

EXAMPLES

Example 1

Tensile and Flexibility Tests

Individual webs prepared from rayon fibers were immersed in an emulsion bath of poly(hydroxybutyrate/hydroxyvalerate) copolymer sold under the tradename Biopol by ICI at solids contents varying from 2–14% for approximately 5–10 seconds. After removal from the bath, the webs were passed through nip rolls to remove excess emulsion, dried on a teflon coated drier, cured in a forced air oven for 5 minutes at a temperature of 180° C., and cut into strips 12.7 cm by 2.5 cm. The strips were then evaluated for percent absorption of the copolymer, tensile strength and flexibility on an Instron tensile tester Model 1130 equipped with an environmental chamber at crosshead speed of 12.7 cm/min. The strips were inserted 12.7 cm in machine direction and 2.5 cm in cross machine direction and the gauge length at the start of each test was 7.6 cm. The percent absorption of the copolymer was determined as percent pick up in weight over the base weight. Tensile strength was measured as peak load and flexibility as percent elongation. Peak load and elongation were measured for each strip when dry, soaked in water for one minute, and soaked in methyl ethyl ketone (MEK) for one minute.

As a control, an ethylene vinyl acetate copolymer emulsion [DUR-O-SET E-623 (25-1823), a 0° C. $T_g$ emulsion polymer available from National Starch and Chemical Company], which is currently used in similar nonwoven bonding applications, was also tested. As in standard self-crosslinking emulsions, a catalyst, ammonium chloride added at 1% catalyst solids, was used to maximize curing and thus end-use strength performance.

The results of the tests are shown in TABLE I.

TABLE I

Emulsified Biopol Pickup Study on Rayon Substrate
Tensile Results

| BINDER SYSTEM | % BATH SOLIDS | % PICKUP | DRY PEAK LOAD | DRY % ELONG | WET PEAK LOAD | WET % ELONG | MEK PEAK LOAD | MEK % ELONG |
|---|---|---|---|---|---|---|---|---|
| Emulsified Biopol | 2 | 5 | *** | *** | *** | *** | *** | *** |
| | 5 | 44 | 0.3 lbs | 18% | 0.2 lbs. | 87% | 0.1 lbs. | 6% |
| | 10 | 119 | 1.8 | 11 | 0.7 | 36 | 0.4 | 3 |
| | 14 | 158 | 3.1 | 9 | 0.9 | 22 | 0.9 | 2 |
| 25-1823 EVA + | 2 | 2 | 0.5 | 3 | 0.2 | 21 | 0.2 | 2 |
| CATALYST | 5 | 7 | 1.2 | 4 | 0.5 | 22 | 0.4 | 2 |
| (1% SOS | 10 | 15 | 1.9 | 9 | 0.8 | 21 | 0.8 | 3 |
| AMMONIUM CHLORIDE) | 14 | 21 | 2.4 | 10 | 0.8 | 17 | 1.0 | 3 |

Tensile and elongation results indicate that rayon fabrics saturated with the emulsified poly(hydroxybutyrate/hydroxyvalerate) copolymers can possess nonwoven performance equal to that of nonwoven substrates bound with conventional binders. However, a percent pick-up of the poly(hydroxybutyrate/hydroxyvalerate) copolymer greater than 5% is necessary to achieve acceptable nonwoven fabric integrity. As shown, pick-up levels above 100% are necessary to achieve strength equal to that of the control.

Example II

Biodegradability Study

Three samples of rayon web substrate, unsaturated with binder, saturated with the poly(hydroxybutyrate/hydroxyvalerate) copolymer, and saturated with a conventional ethylene/vinyl acetate crosslinking binder, were tested for biodegradability using the Biometer Technique (Bartha, R. and Pramer, D., Soil Sci. 100:68, 1965). Biodegradation is defined as the process whereby living organisms bread down a material into naturally occurring molecules, such as, carbon dioxide, methane, water, inorganic and organic salts, or convert it into biomass. Biodegradability was determined by measuring carbon dioxide evolution from duplicates of each of the test samples mixed in soil after incubation in a biometer flask.

The samples and soil were charged to a biometer flask and incubated in an environment with conditions that favor microbial activity (Pramer, D. and Bartha, R., 1972, Environ. Letters 2(4):217–224). The biometer flask was designed specifically for measuring the ultimate biodegradation of substances in soil and consists of an Erlenmeyer main flask fitted with a filter, a side tube fitted with a stopper, and a glass bridge connecting the main flask and the side tube. The main Erlenmeyer flask holds the test sample in soil. The side tube contains alkali for absorbing carbon dioxide.

Dry soil (25 g) was used for each sample. Moisture content and soil pH were adjusted to required levels by adding specific amounts of water and $CaCO_3$. To ensure proper mineral nutrient balance for biodegradation, 0.5 ml of a 1% $(NH_4)_2HPO_4$ solution was added to each flask. In each case, 0.1 g samples of the nonwoven fabrics were shredded, then added to the reaction flasks. Incubation of test samples occurred under conditions that were optimal for aerobic activity of microorganisms. The soil was maintained at room temperature, at a neutral pH level of 6.8, and with a moisture content of approximately 50% of its water holding capacity.

The carbon dioxide produced by the soil and the test sample in the main flask compartment, was absorbed by the alkali (KOH) in the side tube. The alkali was periodically removed and the trapped $CO_2$ was measured by volumetric titration. The alkali was then replaced and the measurement continued. The filter on the main flask compartment was used to prevent atmospheric $CO_2$ from entering the apparatus. The net $CO_2$ evolution from the test samples were calculated by substracting the $CO_2$ evolution of the soil control from that of the samples. Net $CO_2$ evolution from the nonwoven fabrics were plotted cumulatively with time, with the values representing the average of the duplicate flasks for each sample.

The study was conducted for 88-days and significant amounts of $CO_2$ evolved in all test samples after subtracting the soil control. The most extensive $CO_2$ evolution was evident in the poly(hydroxybutyrate/hydroxylvalerate) copolymer, as indicated in the data table. Reduced levels of $CO_2$ evolution were noted with the unbonded rayon and the EVA-saturated rayon controls. For all three samples, the amount of $CO_2$ evolved at the end of the 88-day period was still substantial, indicating that the biodegradation process was not yet complete.

The final data was converted into quantitative estimates of biodegradation by determining the gram atom carbon content of each sample. The results are set out in Table II.

TABLE II

| Sample | % Carbon | % CO Evolved |
|---|---|---|
| Biopol Saturated Rayon (16% pick-up) | 40.3 | 167.8 |
| Unbonded Rayon | 49.1 | 110.8 |
| E623 Saturated Rayon (22% pick-up) | 44.6 | 104.2 |

The table shows the percent carbon content and percent carbon converted to $CO_2$ for each test sample. According to biodegradation estimates (Alexander, M., 1977, Introduction to Soil Microbiology, 2nd Ed., Wiley & Sons, New York; Bartha, R., 1990, Isolation of Microorganisms that Metabolize Xenobiotic Compounds, pp. 283–307. In:The Isolation of Biotechnological Microorganisms from Nature (D. P. Labeda, Ed). Macmillan, New York, N.Y.), it is assumed that 50% of the carbon in mineralized organic matter is evolved as $CO_2$ and 50% is fixed in microbial biomass and soil humus. The amount and rate at which a material degrades is dependent on a complex series of factors that influence microbial numbers and growth. It is possible that the conditions for this study became more favorable toward microbial activity, such as those found in an anaerobic environment. If the amount of aeration in the environment was inadequate for respiration to occur, there may have been a pH shift in the soil, resulting in fermentation. In this case, additional $CO_2$ may have been evolved from the excess carbonate produced in the samples.

Results indicate that rayon saturated with the poly (hydroxybutyrate/hydroxyvalerate) copolymer will degrade faster than the rayon substrate alone, or when it has been saturated with a conventional EVA crosslinking nonwoven binder.

We claim:

1. A biodegradable binder for nonwovens comprising an emulsion of 5–200% solids by weight of poly (hydroxybutyrate/hydroxyvalerate) copolymer in water in which the copolymer comprises 70–100 mole percent of 3 hydroxybutyrate and 0–30 percent of 3-hydroxyvalerate.

2. A biodegradable binder for nonwovens according to claim 1 in which the emulsion is present at 7–50% solids by weight.

3. A biodegradable nonwoven fabric bound with an emulsion of 5–200% solids of poly(hydroxybutyrate/hydroxyvalerate) copolymer in water in which the copolymer comprises 70–100 mole percent of 3 hydroxybutyrate and 0–30 percent of 3-hydroxyvalerate and the nonwoven fabric is impregnated with the emulsion in an amount calculated on a dry basis of about 50–200 parts emulsion per 100 parts by weight of the unbound fabric.

4. A biodegradable nonwoven fabric according to claim 3 in which the fabric is prepared from fibers selected from the group consisting of cellulosic rayon, pulp, viscose, wool, cotton, and cellulose acetate.

* * * * *